United States Patent [19]

Nakano et al.

[11] 4,397,281

[45] Aug. 9, 1983

[54] ELECTRONIC CONTROL DEVICE FOR AN AUTOMOBILE

[75] Inventors: Jiro Nakano, Okazaki; Hironobu Ono, Toyota; Hideo Miyagi, Okazaki, all of Japan

[73] Assignee: Toyota Jidosha Kogyo Kabushiki Kaisha, Toyota, Japan

[21] Appl. No.: 304,051

[22] Filed: Sep. 21, 1981

[30] Foreign Application Priority Data

Sep. 26, 1980 [JP] Japan ..... 55-133011

[51] Int. Cl.[3] ..... F02B 3/00

[52] U.S. Cl. ..... 123/486; 123/488; 123/480; 123/416; 123/179 B; 123/491

[58] Field of Search ..... 123/478, 479, 480, 486, 123/487, 488, 491, 416, 417, 179 B

[56] References Cited

U.S. PATENT DOCUMENTS

| | | | |
|---|---|---|---|
| 3,589,345 | 6/1971 | Benson | 123/478 |
| 3,969,614 | 7/1976 | Moyer et al. . | |
| 4,128,082 | 12/1978 | Aoki | 123/486 |
| 4,180,020 | 12/1979 | Reddy | 123/478 |
| 4,245,590 | 1/1981 | Grozinger et al. | 123/488 |
| 4,254,744 | 3/1981 | Mizote | 123/480 |
| 4,271,402 | 6/1981 | Kastura et al. . | |

*Primary Examiner*—Parshotam S. Lall

*Attorney, Agent, or Firm*—Cushman, Darby & Cushman

[57] ABSTRACT

An electronic control device for an automobile is equipped with a circuit for producing a first reset pulse when power is initially supplied to the electronic control device, and a circuit for producing a second reset pulse when the engine is cranked by a starter motor. Thus, an electric digital computer in the electronic control device is initialized in response to not only the first reset pulse but also the second reset pulse.

7 Claims, 4 Drawing Figures

ELECTRONIC CONTROL DEVICE FOR AN AUTOMOBILE

BACKGROUND OF THE INVENTION

The present invention relates to an electronic control device for use in an automobile.

An electronic control device which has an electric digital computer such as a microcomputer so as to electronically control the operations and the various displays of the automobile, usually uses the same power supply as that of the automobile. In the conventional electronic contol device of this type, a reset pulse for initializing the digital computer in the electronic control device is produced only when power is initially supplied by turning on the ignition switch.

If a starter motor is energized after the ignition switch has been turned on, however, the battery voltage greatly drops due to a current which dashes into the starter motor to a level which is lower than the voltage level required by an electronic control system, such as a digital computer, to operate without error. Such a drop in voltage cannot be compensated for even by the use of a constant-voltage circuit, and the electronic control system often operates erroneously. Further, sensors attached to the external side of the electronic control device often produce abnormal signals with a great decrease in the battery voltage, and this gives rise to the occurrence of erroneous operation in the electronic control system. The latter problem could not be solved even if attempts were made to make the power-supply voltage applied to the electronic control system completely constant. In other words, the latter problem could not be solved by the conventional art.

SUMMARY OF THE INVENTION

It is, therefore, an object of the present invention to provide an electronic control device for an automobile, which can be prevented from being erroneously operated if the power supply voltage drops during the starting of the engine or if abnormal signals are produced by the sensors during starting.

According to the present invention, an electronic control device for an automobile which is equipped with an internal combustion engine, a starter motor for cranking the engine and a common power supply for the starter motor and for the electronic control device, comprises: a first circuit for producing a first reset pulse when power is initially supplied to the electronic control device; a second circuit for producing a second reset pulse when the engine is cranked by the starter motor; and an electrical digital computer initialized in response to both of said first and second reset pulses.

The above and other related objects and features of the present invention will be apparent from the description of the present invention set forth below, with reference to the accompanying drawings, as well as from the appended claims.

DETAILED DESCRIPTION OF THE PREFERRED EMBODIMENT

Figure 1:
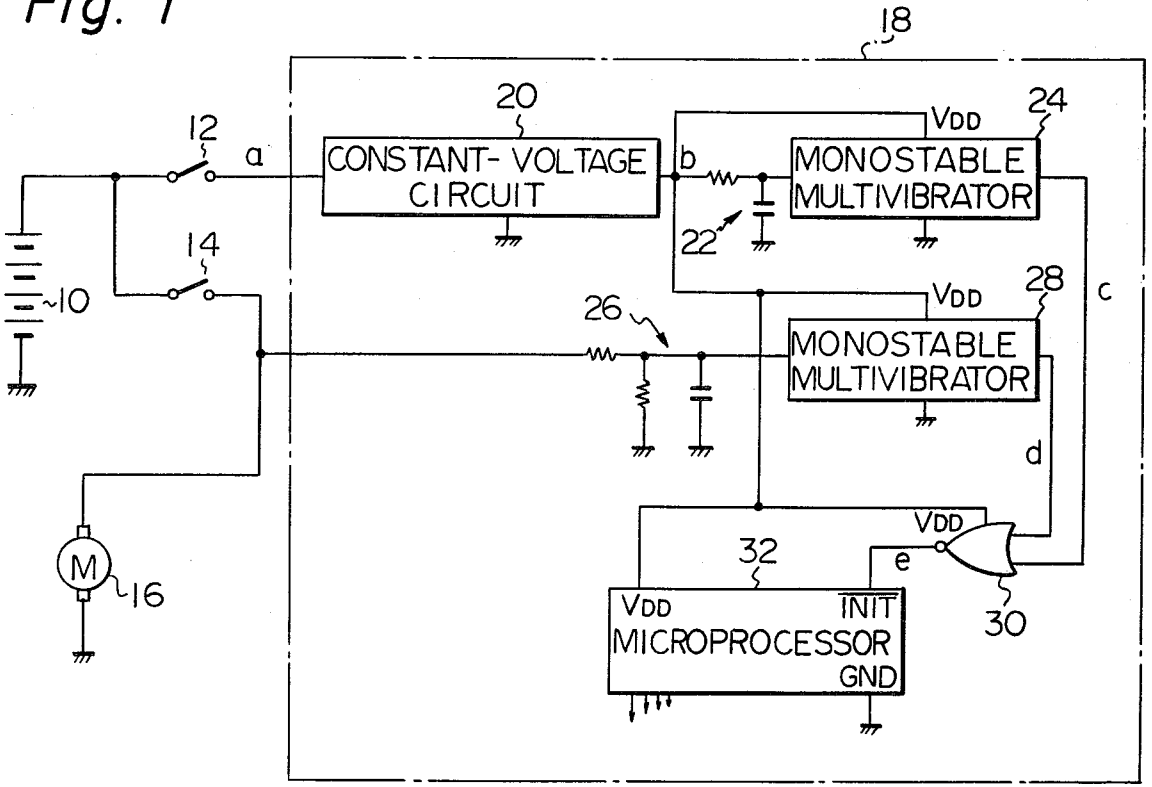
FIG. 1 is a circuit diagram illustrating an electronic control device according to the present invention.

Referring to FIG. 1, which illustrates an embodiment of the present invention, reference numeral 10 denotes a battery, 12 denotes an ignition switch, 14 denotes a starter switch, 16 denotes a starter motor which will be energized when the starter switch 14 is turned on, and 18 denotes an electronic control device. The electronic control device 18 is equipped with a constant-voltage circuit 20 which converts a power-supply voltage fed from the battery 10 via the ignition switch 12 into a constant voltage of, for example, 5 volts, and which feeds the constant voltage to every element in the electronic control device 18. A first monostable multivibrator 24 is connected to the output terminal of the constant-voltage circuit 20 via a delay circuit 22. The electronic control device 18 further has a second monostable multivibrator 28 which is connected to the output terminal of the starter switch 14 via a delay circuit 26. The output terminals of the first and second monostable multivibrators 24 and 28 are connected to the two input terminals of a NOR circuit 30. The output terminal of the NOR circuit 30 is connected to an initial reset terminal of a microprocessor 32 which constitutes a major portion of a microcomputer that performs a variety of controls, and which further includes an input/output interface circuit and the like. As required, furthermore, the output terminal of the NOR circuit 30 will be connected to initial set terminals of other electronic circuits that must be initialized.

Figure 2:
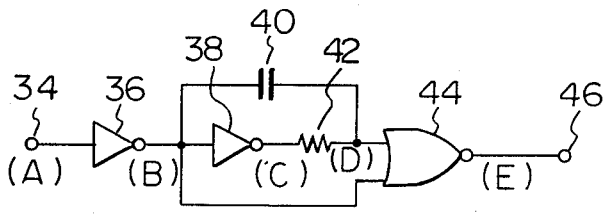
FIG. 2 is a circuit diagram of a monostable multivibrator in the control device shown in FIG. 1.
Figure 3:
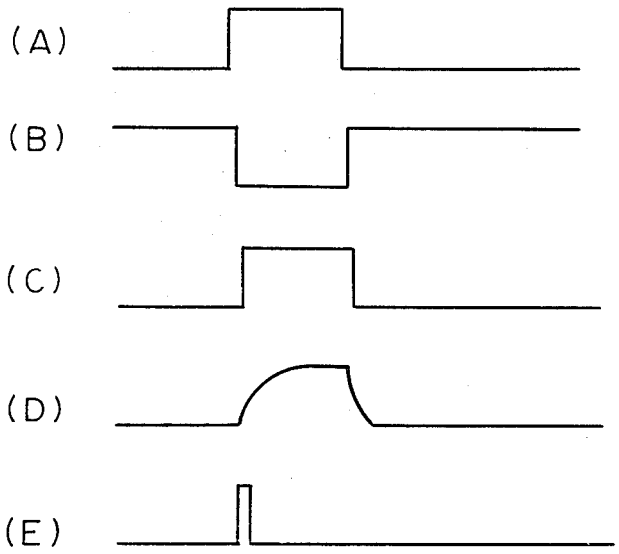
FIG. 3 contains five wave forms (A), (B), (C), (D) and (E) for illustrating the operations of the monostable multivibrator of FIG. 2.

The monostable multivibrators 24 and 28 are triggered by the rising edge of the input voltage, and generate reset pulses of a predetermined pulse width. FIG. 2 illustrates a setup of the monostable multivibrator. A voltage of a waveform shown in FIG. 3(A) is applied to an input terminal 34, and is inverted by an inverter 36 into a waveform as shown in FIG. 3(B). The voltage is further inverted by an inverter 38 into a waveform as shown in FIG. 3(C). Therefore, a differential voltage between the voltage of FIG. 3(B) and the voltage of FIG. 3(C) is applied across both terminals of a series circuit consisting of a capacitor 40 and a resistor 42. Therefore, a voltage at a point between the capacitor 40 and the resistor 42, i.e., an input voltage of a NOR circuit 44, becomes as shown in FIG. 3(D). Another input voltage of the NOR circuit 44 is equal to the output voltage of the inverter 36, which is shown in FIG. 3(B). Therefore, the NOR circuit 44 produces an output voltage which is shown in FIG. 3(E). That is, according to the construction of FIG. 2, if a voltage shown in FIG. 3(A) is applied to the input terminal 34, a pulse shown in FIG. 3(E) is produced on the output terminal 46.

Figure 4:
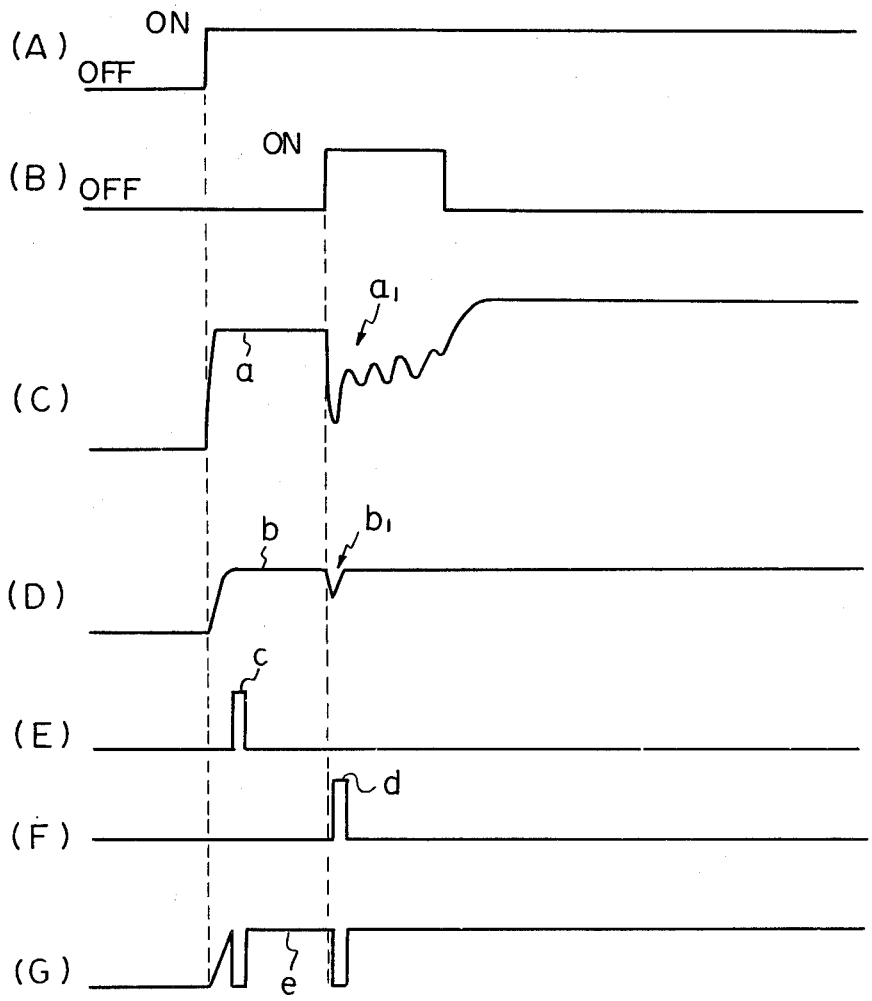
FIG. 4 contains seven wave forms (A), (B), (C), (D), (E), (F) and (G) for illustrating the effects and the operations of the electronic control circuit of FIG. 1.

Next, the operation of the embodiment of FIG. 1 is mentioned below in conjunction with a wave form diagram of FIG. 4. As the ignition switch 12 is turned on at a timing shown in FIG. 4(A), a power-supply voltage a applied to the constant-voltage circuit 20 rises as shown in FIG. 4(C). Thus, the constant-voltage circuit 20 produces an output voltage b as shown in FIG. 4(D). The output voltage b is delayed by a delay circuit 22, and is applied to the first monostable multivibrator 24. Therefore, the monostable multivibrator 24 is triggered to produce an output pulse c as shown in FIG.

4(E). The above delay processing is to set the device to the initial condition after the output voltage b of the constant-voltage circuit 20 is sufficiently raised and stabilized.

Then, when the starter switch 14 is turned on at a timing shown in FIG. 4(B), the second monostable multivibrator 28 is triggered being suitably delayed by the delay circuit 26. Therefore, an output pulse d is produced as shown in FIG. 4(F).

When the output pulses c and d of the first and second monostable multivibrators 24 and 28 are applied to the NOR circuit 30, a reset signal e shown in FIG. 4(G) is applied to the initial reset terminal of the microprocessor 32. That is, the microprocessor 32 is initialized twice responsive to the output pulses of the first and second monostable multivibrators 24 and 28.

When the starter switch 14 is turned on to energize the starter motor 16, the power-supply voltage drops greatly as represented by a portion $a_1$ of FIG. 4(C). Even if it is attempted to make the voltage constant by using the constant-voltage circuit 20, the output voltage drops when the starter motor 16 is energized as represented by the portion $b_1$ of FIG. 4(D). According to the embodiment of the present invention as mentioned above, however, the microprocessor 32 is initialized again responsive to the output pulse d from the second monostable multivibrator 28. Therefore, it is possible to reliably prevent the occurrence of erroneous operation that will be caused by the drop in battery voltage when the engine is to be started. It is further possible to reliably prevent the device from being erroneously operated by abnormal signals that are produced by the external sensors when the battery voltage drops.

According to the present invention as mentioned in detail in the foregoing, a reset pulse is formed again when the engine is to be started, and the digital computer is initialized again. Hence, the electronic control system can be reliably prevented from being erroneously operated by a drop in battery voltage when the engine is to be started. When the device of the present invention is to be put into practice, furthermore, it only needs be equipped with a simply constructed circuit.

As many widely different embodiments of the present invention may be constructed without departing from the spirit and scope of the present invention, it should be understood that the present invention is not limited to the specific embodiments described in this specification, except as defined in the appended claims.

I claim:

1. An electronic control device for an automobile having an internal combustion engine, a starter motor for cranking the engine and a common power supply for the starter motor and for the electronic control device, comprising:

a first circuit for producing a first reset pulse when power is initially supplied to the electronic control device;

a second circuit for producing a second reset pulse when the engine is cranked by the starter motor; and an electric digital computer initialized in response to both of said first and second reset pulses.

2. An electronic control device as claimed in claim 1, wherein said first circuit includes a monostable multivibrator for producing a first reset pulse when power is initially supplied to the electronic control device.

3. An electronic control device as claimed in claim 2, wherein said automobile has an ignition switch for switching on or off the electronic control device, and said multivibrator produces a first reset pulse when the ignition switch is turned on.

4. An electronic control device as claimed in claim 3, wherein said first circuit includes a delay circuit connected between said ignition switch and said multivibrator, for delaying the phase of said first reset pulse by a predetermined time.

5. An electronic control device as claimed in claim 1, wherein said second circuit includes a monostable multivibrator for producing a second reset pulse when the engine is cranked by the starter motor.

6. An electronic control device as claimed in claim 5, wherein said automobile has a starter switch for switching on or off the starter motor, and said multivibrator produces a second reset pulse when the starter switch is turned on.

7. An electronic control device as claimed in claim 6, wherein said second circuit includes a delay circuit connected between said starter switch and said multivibrator, for delaying the phase of said second reset pulse by a predetermined time.

* * * * *